United States Patent [19]

Maru

[11] Patent Number: 5,009,580

[45] Date of Patent: Apr. 23, 1991

[54] MULTIPLE RECIPROCATING PUMP

[75] Inventor: Shingo Maru, Chiba, Japan

[73] Assignee: Maruyama Mfg. Co., Ltd., Tokyo, Japan

[21] Appl. No.: 572,224

[22] Filed: Aug. 24, 1990

[30] Foreign Application Priority Data

Dec. 28, 1989 [JP] Japan ..... 1-338358

[51] Int. Cl.[5] ..... F04B 23/06

[52] U.S. Cl. ..... 417/533; 417/539; 92/73

[58] Field of Search ..... 417/521, 533, 539; 92/73, 72, 64, 48, 49

[56] References Cited

U.S. PATENT DOCUMENTS 3,282,224 10/1990 Bock et al. ..... 417/539
4,515,537 10/1990 Areus ..... 417/521
4,824,342 10/1990 Buck ..... 417/539

*Primary Examiner*—Leonard E. Smith
*Assistant Examiner*—Charles G. Freay, Jr.
*Attorney, Agent, or Firm*—Cushman, Darby & Cushman

[57] ABSTRACT

A multiple reciprocating pump such as a triple diaphragm or piston pump has a drive shaft (28), a plurality of reciprocating rods (48*a*, 48*b*, 48*c*) arranged in parallel with one another at one side of the drive shaft (28) and capable of reciprocating in accordance with rotation of the drive shaft (28); Displaceable members (56*a*, 56*b*, 56*c*) such as diaphragms or pistons secured to the ends of the reciprocating members (48*a*, 48*b*, 48*c*) and defining wall members of pump chambers (54*a*, 54*b*, 54*c*). The wall members (56*a*, 56*b*, 56*c*) are displaceable in accordance with the reciprocating movement of the reciprocating members (48*a*, 48*b*, 48*c*) so as to vary the volumes of the pump chambers (54*a*, 54*b*, 54*c*) thereby sucking in and discharging a liquid. The reciprocating members (48*a*, 48*b*; 48*b*, 48*c*) which are adjacent to each other in the direction of axis of the drive shaft (28) have different lengths. The pump chambers (54*a*, 54*b*; 54*b*, 54*c*) which are adjacent to each other in the direction of axis of the drive shaft (28) are offset in the direction of axes of the reciprocating members (48*a*, 48*b*, 48*c*).

8 Claims, 2 Drawing Sheets

MULTIPLE RECIPROCATING PUMP

BACKGROUND OF THE INVENTION

1. Field of the Invention

The present invention relates to a multiple reciprocating pump suitable for use in, for example, a powered atomizer for spraying and atomizing a chemical liquid. More particularly, the present invention is concerned with a multiple reciprocating pump which can have an increased capacity or displacement without an accompanying increase in size.

2. Description of the Related Art

Multiple piston pumps, suitable for use in powered atomizers for spraying and atomizing chemical liquids or rinsing water are known, for example, as disclosed in Japanese Utility Model Laid-Open No. 60-73885 and Japanese Utility Model Publication No. 63-39429. In such a multiple piston pump, a plurality of piston rods of an equal length are arranged in parallel on the same side of a crankshaft and a plurality of pump chambers are arranged in a row on the same side of the crankshaft as the piston rods. The pistons carried by the piston rods reciprocate in the respective pump chambers so as to increase and decrease the volumes of the pump chambers.

In this known multiple piston pump, the cross-sectional areas of the pump chamber and the piston are undesirably limited by the spacing of piston rods and by the thickness of the partition wall between adjacent piston rods. Thus, it is difficult to design the pump with large cross-sectional areas of the pump chamber and the piston respectively. In other words, in order to increase the capacity or displacement of the multiple piston pump by increasing the cross-sectional areas of the piston chamber and the piston, it is necessary to increase the spacing of the pistons, resulting in an increase in the size of the whole piston pump. It would be possible to increase the capacity of the multiple piston pump by increasing the speed of rotation of the crankshaft. In such a case, however, the pistons, cylinders and seals of the pump would be worn down very quickly.

SUMMARY OF THE INVENTION

Accordingly, an object of the present invention is to provide a multiple reciprocating pump having a plurality of reciprocating members arranged in parallel on one side of a common drive shaft, wherein the capacity of the pump can be increased without requiring the spacing of the reciprocating members to be increased.

In accordance with the above object, the present invention provides a multiple reciprocating pump comprising a drive shaft, a plurality of reciprocating members operably connected to the drive shaft, and a pump chamber corresponding to each reciprocating member. The reciprocating members have parallel axes, are disposed to one side of the drive shaft and are operably connected to the shaft to reciprocate along these axes. Each reciprocating member has a length along its axis different from the length of a next adjacent reciprocating member. Each chamber has a wall member operably connected to the respective reciprocating member to reciprocating with the reciprocating member and thereby increase and decrease the volume of the pump chamber to take in and discharge liquid. Each chamber is displaced from the nearest adjacent chamber in the direction of the axes of the reciprocating members.

Further objects, features and advantages of the present invention will become apparent from the Description of the Preferred Embodiments which follows, when considered together with the attached drawings.

DESCRIPTION OF THE PREFERRED EMBODIMENTS

Figure 1:
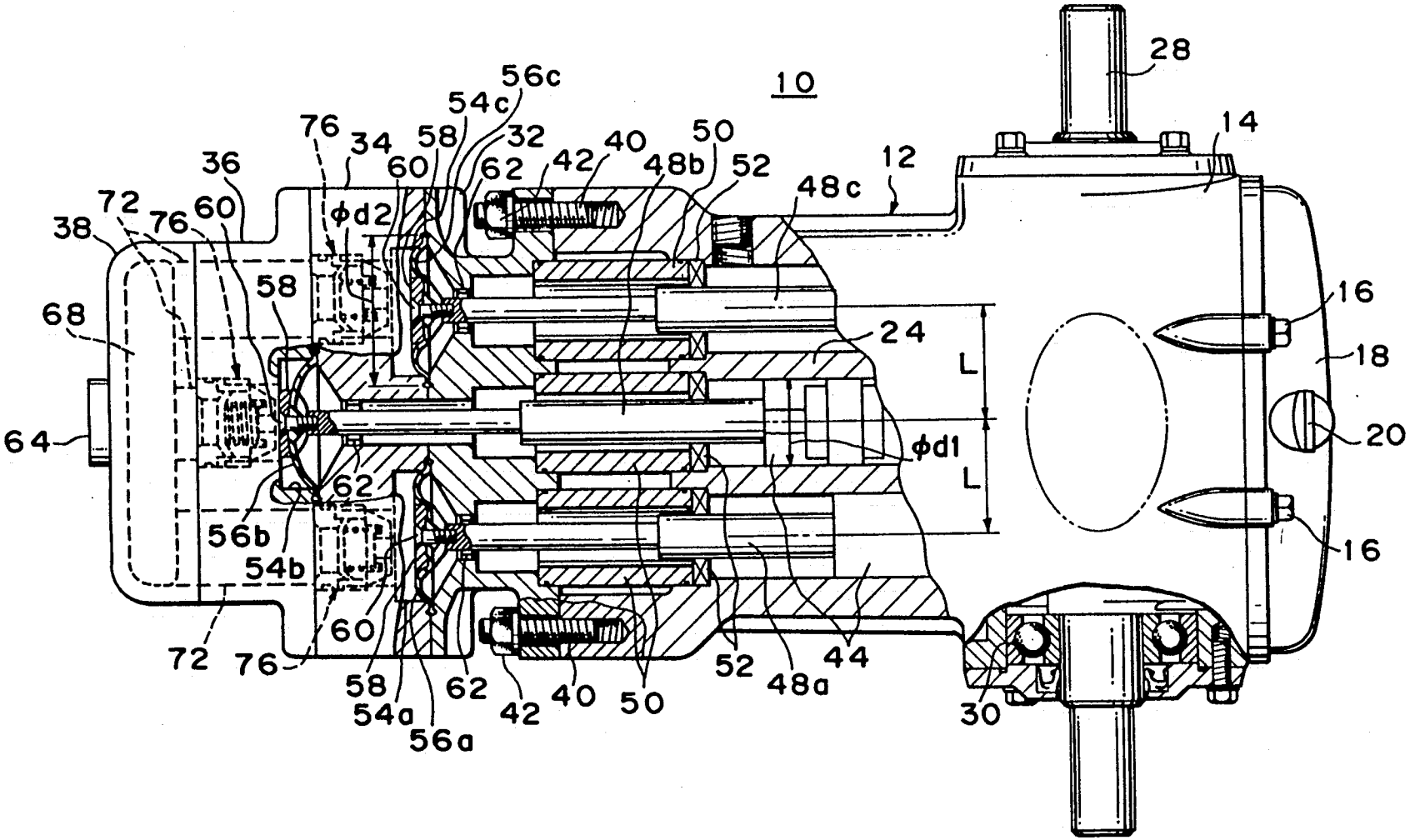
FIG. 1 is a partly-sectioned plan view of a triple diaphragm pump embodying the present invention.

Referring to the drawings, a multiple reciprocating pump of the present invention comprises: a drive shaft (28); a plurality of reciprocating members (48*a*, 48*b*, 48*c*) arranged in parallel with one another at one side of the drive shaft (28) and capable of reciprocating in accordance with rotation of the drive shaft (28); displaceable members (56*a*, 56*b*, 56*c*) secured to the ends of the reciprocating members (48*a*, 48*b*, 48*c*) and defining parts of pump chambers (54*a*, 54*b*, 54*c*), the displaceable members (56*a*, 56*b*, 56*c*) being displaceable in accordance with the reciprocating movement of the reciprocating members (48*a*, 48*b*, 48*c*) so as to increase and decrease the volumes of the pump chambers (54*a*, 54*b*, 54*c*) thereby sucking in and discharging a liquid. In this pump, the reciprocating members (48*a*, 48*b*; 48*b*, 48*c*) which are adjacent to each other in the direction of axis of the drive shaft (28) have different lengths, and the pump chambers (54*a*, 54*b*; 54*b*, 54*c*) which are adjacent to each other in the direction of axis of the drive shaft (28) are offset in the direction of the axes of the reciprocating members (48*a*, 48*b*, 48*c*).

In operation, the reciprocating members 48*a*, 48*b*, 48*c* reciprocate in accordance with the rotation of the drive shaft 28 so that the displaceable members 56*a*, 56*b*, 56*c* which are attached to the ends of the reciprocating members 48*a*, 48*b*, 48*c* are reciprocatingly displaced so as to increase and decrease the internal volumes of the pump chambers 54*a*, 54*b*, 54*c*. The pump chambers 54*a*, 54*b* and 54*c* which are adjacent each other as viewed in the direction of axis of the drive shaft 28 and are offset in the direction of axes of the reciprocating members 48*a*, 48*b*, 48*c*. In addition, the stroke ranges of the displaceable members 56*a*, 56*b*, 56*c* also are offset in the direction of axes of the reciprocating members 48*a*, 48*b*, 48*c* such that the stroke ranges of adjacent displaceable member do not overlap each other.

An embodiment of the invention will be described with reference to the accompanying drawings.

Figure 2:
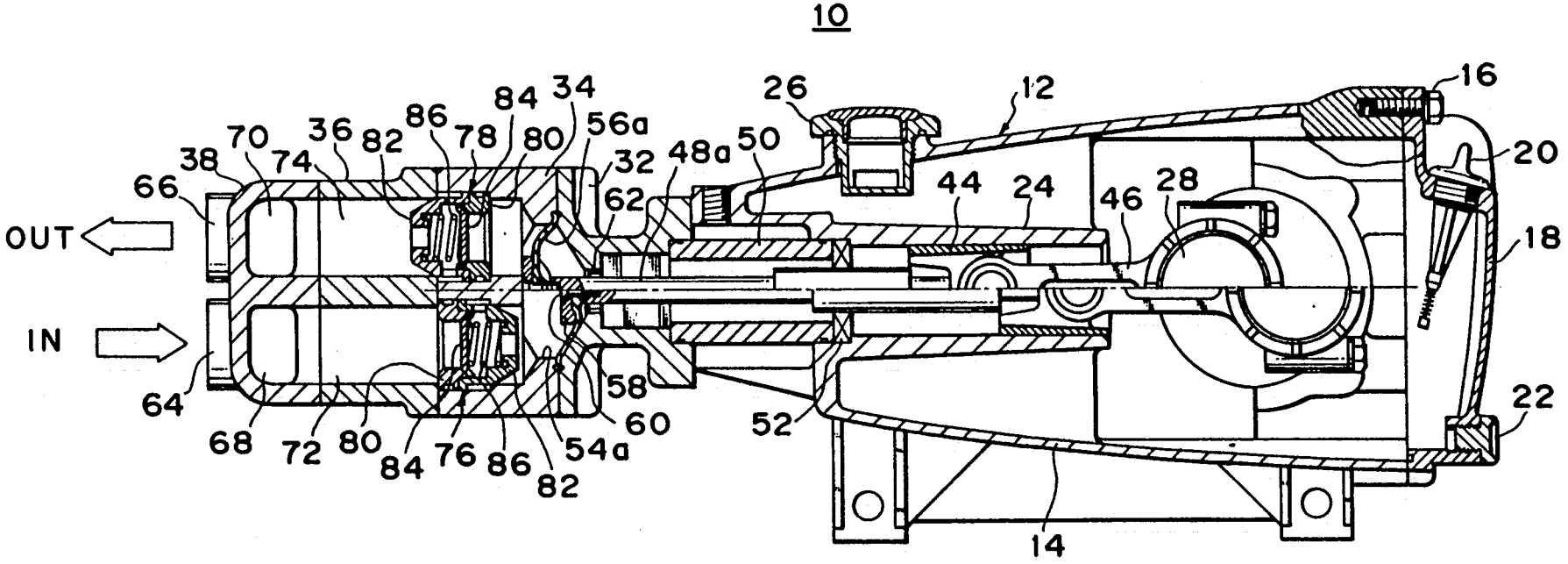
FIG. 2 is a longitudinal sectional view of the triple diaphragm pump shown in FIG. 1.

FIGS. 1 and 2 are a partly-sectioned plan view and a longitudinal sectional view respectively, of a triple diaphragm pump embodying the present invention. This triple diaphragm pump 10 is used for the purposes of, for example, spraying chemical liquids over agricultural fields or spraying rinsing water or liquids onto various articles to be cleaned. The pump has a crank case 12 which includes a case body 14 having an opening and a case lid 18 detachably secured by bolts to the case body 14 by means of bolts so as to close the opening. An oil gauge capable of indicating the level of lubricating oil in the crank case 12 is secured to the case lid 18. A drain plug 22 is plugged to a drain port provided in the case lid 18 to enable draining of oil inside the case lid 18. Three guide portions 24 are formed in the case body 14 parallel with one another in such a manner as to open in the end of the case body 14 opposite to the case lid 18.

An oil cap 26 is fitted on the brim of an oil filling port provided on an upper portion of the case body 14. The crankshaft 28 extends through the crank case 12 in a horizontal direction perpendicular to the direction in which the guide portions 24 extend, and is supported on the case body 14 at both its ends by means of ball bearings 30. The guide portions 24 are formed at a regular interval L in the direction of axis of the crankshaft 28. Each guide portion 24 has an internal diameter d1 which is smaller than L (d1<L). Manifolds 32, 34, 36, 38 are mounted on the end of the case body 14 adjacent the guide portions 24. These manifolds are arranged in the mentioned order in the direction in which the guide portions 24 extend. The manifold 32 is fixed to the case body 14 by means of stud bolts 40 and nuts 42, while the manifolds 34, 36, 38 are fastened to the case body 14 by means of bolts which are not shown.

A crosshead 44 is slidably fitted in each guide portion 24 so as to be guided by the guide portion 24 in a horizontal direction perpendicular to the axis of the crankshaft 28. The crosshead 44 is connected to the crankshaft 28 through a connecting rod 46 so as to reciprocate as the crankshaft 28 rotates. The reciprocating rods **48*a*, 48*b*, 48*c* are screwed to the ends of the respective crossheads 44 so as to extend in the direction of the axes of the crosshead 44. The reciprocating rods 48*a* and 48*c* have an equal length which is smaller than the length of the reciprocating rod 48*b*. Collars 50 are mounted together with oil seals 52 between the case body 14 and the manifold 32 such that the central apertures of these collars 50 are transfixed by the reciprocating rods 48*a*, 48*b*, 48*c*. Oil seals 52 are slidingly contacted by the reciprocating rods 48*a*, 48*b*, 48*c* at their inner peripheral edges so as to prevent the leakage of oil from the crank case 12**.

The pump chambers **54*a*, 54*b*, 54*c* have an equal diameter d2 which is larger than the diameter d1 of the guide portions. These pump chambers 54*a*, 54*b*, 54*c* are formed on the extensions of the reciprocating rods 48*a*, 48*b*, 48*c*. Among these pump chambers, two chambers 54*a* and 54*c* are formed on the joint surface of the manifold 34 adjacent the manifold 32. Pump chamber 54*b* is formed on the joint surface of the manifold 36 adjacent the manifold 34 such that it is located ahead of the pump chambers 54*a*, 54*c* as viewed in the horizontal direction perpendicular to the crankshaft 28. It is to be noted that, in the conventional multiple piston pump, the diameter d2 of the pump chamber is substantially equal to or smaller than the diameter d1 of the crosshead 44 and the distance L between the axes of the reciprocating members. Diaphragms 56*a*, 56*b*, 56*c* hermetically seal and define the pump chambers 54*a*, 54*b*, 54*c* and are fixed at their central portions to the end surfaces of the reciprocating rods 48*a*, 48*b*, 48*c* by means of washers 58 and bolts 60. The diaphragms 56*a* and 56*c* are clamped at their peripheral edge portions between the joint portions of the manifolds 32 and 34, while the diaphragm 56*b* is clamped at its peripheral edge portion between the joint portions of the manifolds 34 and 36. The guide collars 62 are fixed to step portions of the manifolds 32, 34, 36 so as to receive ends of the reciprocating rods 48*a*, 48*b*, 48*c* so as to guide the reciprocating movement of the reciprocating rods 48*a*, 48*b*, 48*c* together with the guide portion 24 of the crank case 12**.

A suction intake port 64 and a discharge port 66 are formed in lower and upper portions of the end surface of the endmost manifold 38, so as to communicate with a suction intake passage 68 and a discharge passage 70 in the manifold 38. Three branch passages 72 and three branch passages 74 are formed in lower and upper portions, respectively, of each of the manifolds 36 and 38. These branch passages communicate at one of their ends with the suction intake passage 68 and the discharge passage 70, respectively, and at the other of their ends with the pump chambers **54*a*, 54*b* and 54*c***.

Suction intake valves 76 are provided in the ends of the branch passages 72 adjacent the pump chambers **54*a*, 54*b*, 54*c*, while discharge valves 78 are provided in the ends of the branch passage 74 adjacent the pump chambers 54*a*, 54*b*, 54*c*. The suction intake valves 76 allow liquid to flow only in one direction, i.e., from the suction intake passage 68 into the pump chambers 54*a*, 54*b*, 54*c*. The discharge valves 78 also allow the liquid to flow only in one direction, i.e., from the pump chambers 54*a*, 54*b*, 54*c* into the discharge passage 70. The suction intake valve 76 and the discharge valve 78 in this embodiment have an identical construction but are disposed in opposite directions. More specifically, each of the suction valve 76 and the discharge valve 78 has a valve seat 80 and a valve sack 82 which are joined at their peripheral regions, a valve member 84 disposed in the valve sack 82 for movement into and out of contact with the valve seat 80, and a compression coiled spring 86 for urging the valve member 84 onto the valve seat 80**.

The operation of this embodiment is as follows.

The crankshaft 28 is rotatingly driven by power transmitted from, for example, an engine or an electric motor which is not shown, so that the reciprocating rods **48*a*, 48*b*, 48*c* reciprocate while being guided by the crossheads 44 and the guide collars 62**.

The pump chambers **54*a*, 54*b*, 54*c* each perform the same operation. The operation of pump chamber 54*a***, therefore, will be explained as a representative example of how each of the chambers functions.

When the reciprocating rod **48*a* is moved towards the crankshaft 28, i.e., during the suction stroke, the diaphragm 56*a* is pulled at its central portion towards the crankshaft 28 so that the volume of the pump chamber 54*a* increases. Consequently, a negative pressure is established in the pump chamber 54*a* so that the suction valve 76 is opened while the discharge valve 78 is closed. Liquid is then sucked from the suction intake port 64 and introduced into the pump chamber 54*a* through the suction intake passage 68, branch passage 72 and the suction intake valve 76**.

Then, as the reciprocating rod **48*a* moves towards the manifold 38, i.e., during the discharge stroke, the central portion of the diaphragm 56*a* is urged towards the manifold 38 so that the volume of the pump chamber 54*a* is decreased. Consequently, the pressure in the pump chamber 54*a* is increased so that the suction valve 76 is closed while the discharge valve 78 is opened, whereby the liquid is displaced from the pump chamber 54*a* and delivered to the discharge passage 70 through the discharge valve 78 and the branch passage 74**.

Although a diaphragm pump has been specifically described as an embodiment of the present invention, it will be obvious that the invention can equally be applied to a piston pump with the wall members defined by diaphragms **56*a*, 56*b*, 56*c***, being defined by pistons.

In the described embodiment, the reciprocating rods **48*a*, 48*b*, 48*c* are actuated by means of a crankshaft 28. This, however, is not exclusive and a drive system employing cams, as disclosed in Japanese Patent Publication No. 57-32228 for example, can be used in place of the crankshaft 28**.

As has been described, the multiple reciprocating pump of the present invention has a plurality of reciprocating members arranged in parallel with one another on the same side of a common drive shaft, wherein the pump chambers adjacent to each other as viewed in the direction of axis of the drive shaft are offset from each other in the direction of axes of the reciprocating members, so that the pump chambers are allowed to have increased cross-sectional diameter without interfering with adjacent pump chambers, making it possible also to increase the cross-sectional diameter of the displaceable members. It is therefore possible to increase the capacity of the multiple reciprocating pump without requiring the spacing of the reciprocating members to be increased.

Although the present invention has been described with respect to preferred embodiments, one of ordinary skill in the art will recognize that modifications and improvements may be made while remaining within the scope of the present invention which is determined soley by the appended claims.

What is claimed is:

1. A multiple reciprocating pump, comprising:

a drive shaft;

a plurality of reciprocating members having parallel axes and a length in the direction of the axes, being disposed to one side of the drive shaft, and being operably connected to the drive shaft to reciprocate along said axes, wherein the length of each reciprocating member is different from the length of a nearest adjacent member; and a pump chamber corresponding to each reciprocating member, each chamber having a volume and wall member operably connected to reciprocate with the corresponding reciprocating member, wherein the volume of the pump chamber increases and decreases as the wall member reciprocates to take in and discharge fluid from the pump chamber, and wherein each chamber is displaced from a nearest adjacent chamber in the direction of the axes of the reciprocating members.

2. A reciprocating pump according to claim 1, further comprising crankshaft means for operably connecting said reciprocating members with said shaft.

3. A reciprocating pump according to claim 1, further comprising cam means for operably connecting said reciprocating members with said shaft.

4. A reciprocating pump according to claim 1, wherein said wall member comprises a diaphram.

5. A reciprocating pump according to claim 1, wherein said wall mamber comprises a piston.

6. A reciprocating pump according to claim 1, wherein each of said pump chambers comprises an intake valve for allowing fluid into the pump chamber when said volume increases and a discharge valve for allowing fluid to be discharged from the pump chamber when the volume decreases.

7. A reciprocating pump according to claim 1, wherein said wall member of each pump chamber has a stroke range in the direction of the axes of the reciprocating members and the stroke range of each wall member does not overlap the stroke range of the wall member of a next adjacent pump chamber.

8. A reciprocating pump according to claim 1, wherein the pump chambers have a diameter d2, the axis of each reciprocating member is separated from the axis of a next adjacent reciprocating member by a distance L, and d2 is greater than L.

* * * * *